US007069765B2

(12) United States Patent
Grove et al.

(10) Patent No.: US 7,069,765 B2
(45) Date of Patent: Jul. 4, 2006

(54) RELEASE MECHANISM FOR END FORMING MACHINE

(75) Inventors: John Charles Grove, Huntington, IN (US); Joseph George Deal, North Manchester, IN (US); Bradley Alan Vigar, Urbana, IN (US)

(73) Assignee: Manchester Tool & Die, Inc., North Manchester, IN (US)

( * ) Notice: Subject to any disclaimer, the term of this patent is extended or adjusted under 35 U.S.C. 154(b) by 397 days.

(21) Appl. No.: 10/714,335

(22) Filed: Nov. 14, 2003

(65) Prior Publication Data

US 2005/0103090 A1 May 19, 2005

(51) Int. Cl.
*B26D 7/26* (2006.01)
*B26F 1/14* (2006.01)

(52) U.S. Cl. ..... 72/481.1; 72/316; 72/317; 72/482.91; 72/482.6; 72/482.92; 83/698.31; 83/698.91

(58) Field of Classification Search ..... 83/698.31, 83/698.91; 72/316, 317, 481.1, 482.6, 482.91, 72/482.92

See application file for complete search history.

(56) References Cited

U.S. PATENT DOCUMENTS

| | | | | |
|---|---|---|---|---|
| 1,635,909 | A | 7/1927 | Tobeler | |
| 1,784,911 | A | 12/1930 | Schlitters et al. | |
| 2,154,738 | A | 4/1939 | Fisher | |
| 2,998,839 | A * | 9/1961 | Ingwer | 72/317 |
| 3,052,279 | A * | 9/1962 | Collin et al. | 72/482.91 |
| 3,176,383 | A | 4/1965 | Parker | |
| 3,245,694 | A | 4/1966 | Parker | |
| 3,255,792 | A | 6/1966 | Beck | |
| 3,351,395 | A | 11/1967 | Stone | |
| 4,174,648 | A | 11/1979 | Wallis | |
| 4,316,399 | A | 2/1982 | Wallis | |
| 4,558,620 | A | 12/1985 | Wallis | |
| 4,688,459 | A | 8/1987 | Osborn et al. | |
| 4,726,270 | A * | 2/1988 | Lucas | 83/698.31 |
| 4,813,260 | A | 3/1989 | Strybel | |
| 5,197,368 | A * | 3/1993 | Meyer et al. | 83/698.31 |
| 5,357,835 | A | 10/1994 | Moellering | |
| 5,832,798 | A | 11/1998 | Schneider et al. | |
| 5,881,625 | A | 3/1999 | Wellman | |
| 6,324,768 | B1 | 12/2001 | Wellman | |
| 2002/0157442 | A1 | 10/2002 | Petersen | |

OTHER PUBLICATIONS

Dayton Progress Corporation Catalog; pp. 1-3, 23, 27, 36, and 37; 1993.

(Continued)

*Primary Examiner*—David B. Jones
(74) *Attorney, Agent, or Firm*—Barnes & Thornburg LLP

(57) ABSTRACT

A shuttle assembly for use with an end forming machine includes a shuttle and a release mechanism coupled to the shuttle. The shuttle includes a main body, a tool-receiving bore formed in the main body, and a lock mechanism associated with the tool-receiving bore. The lock mechanism is movable between a locked position where a ball detent of the lock mechanism is biased to extend into the tool-receiving bore and an unlocked position where the ball detent is removed from within the tool-receiving bore. The shuttle assembly further includes a release mechanism coupled to the shuttle for moving the locking mechanism from the locked position to the unlocked position. The release mechanism includes a release lever coupled to the shuttle for pivotable movement relative to the shuttle to engage the ball detent and move the ball detent out of the tool-receiving bore.

13 Claims, 7 Drawing Sheets

OTHER PUBLICATIONS

Website for Wauseon Machine & Manufacturing, Inc., 2 pages; Jul. 30, 2002, www. wauseonmachine.com.

Moeller True-Set; 5 pages from Moeller Manufacturing Company, Inc. catalog.

* cited by examiner

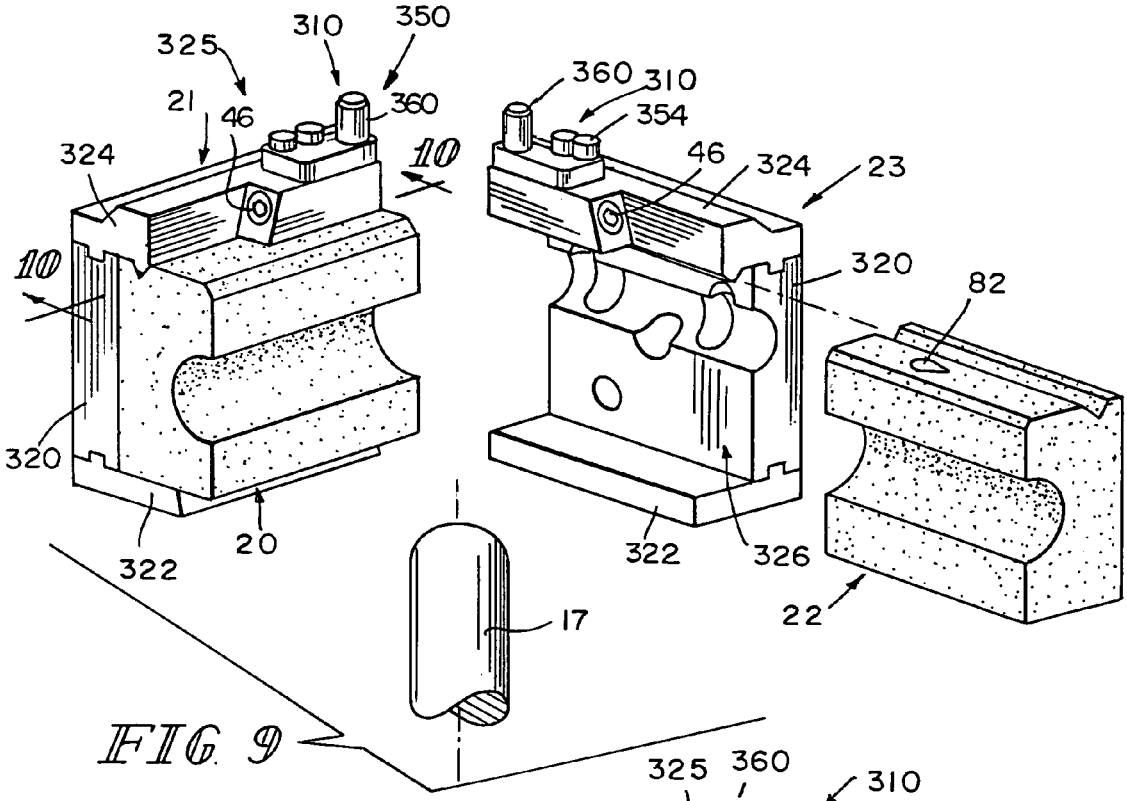
FIG. 9
FIG. 10
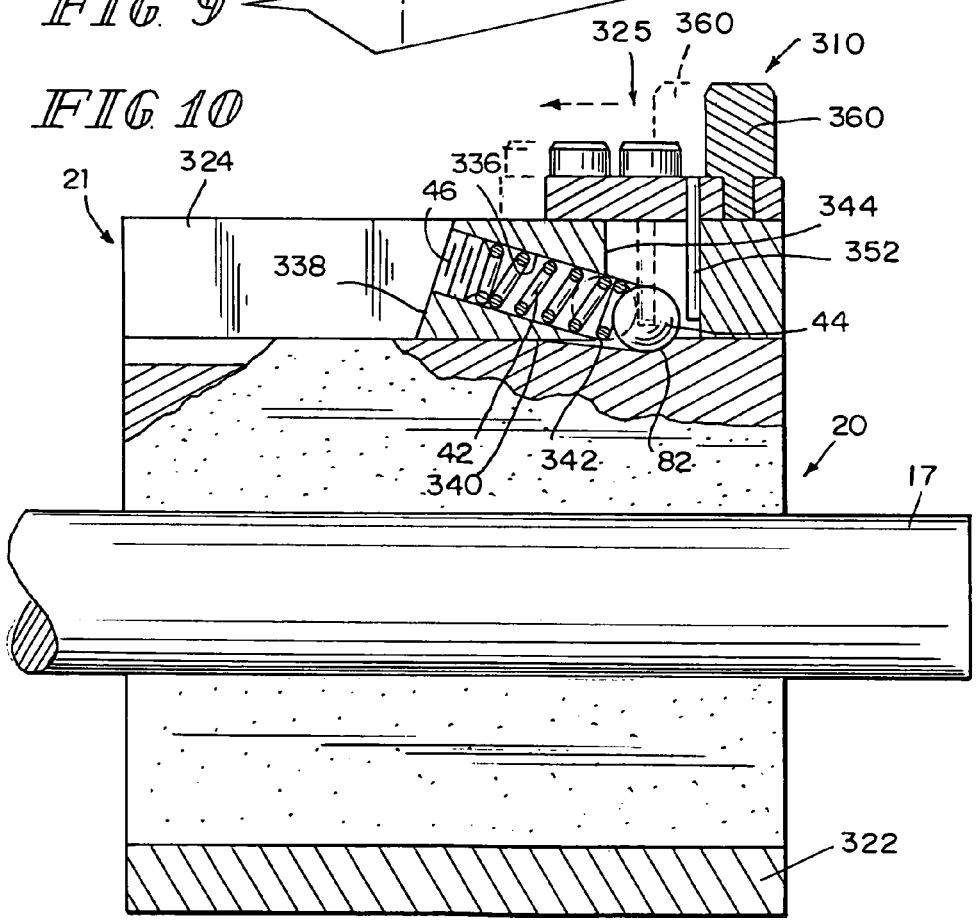

RELEASE MECHANISM FOR END FORMING MACHINE

BACKGROUND

The present disclosure relates to an end forming machine and specifically to the components of the end forming machine such as a shuttle assembly, tool holder, end forming tool, and or jaw holders of the end forming machine. More particularly, the present disclosure relates to a mechanism for quickly and easily replacing one or more of these components of the end forming machine.

Many end forming machines or punch presses include a shuttle assembly coupled to a press platen for back and forth movement with the press platen. The press platen is usually driven by a drive motor. The shuttle assembly is often formed to include a passage to receive an end forming tool therein. If the particular tool is not configured to fit in the shuttle assembly passage, the passage may also receive a tool holder therein. In such an instance, the tool is then coupled to and held by the tool holder.

Various tool retainers or tool holders are disclosed in the following U.S. Pat. Nos. 6,324,768; 4,174,648; 3,176,383; 4,316,399; 4,688,459; 4,558,620; 5,832,798; 5,881,625; 2,154,738; 1,784,911; 3,245,694. Many of these patents disclose a mechanism for quickly and easily locking and releasing the tool and/or tool holder from within the shuttle assembly. U.S. Pat. No. 5,357,835, for example, discloses a ball lock punch or tool retainer where an oblique hole of the punch retainer intersects a hole formed to receive the punch or tool therein. A spring within the oblique hole urges a ball, also within the oblique hole, to partially enter the bore of the punch hole for receiving the tool in order to lock the tool within the punch hole. A small hole in communication with the oblique hole allows an instrument to be inserted therein to move the ball against the spring and release a tool or punch located in the punch hole.

SUMMARY

According to the present disclosure, release mechanisms are provided for use with an end forming machine. These release mechanisms are associated with various components of the end forming machine or end forming assembly and are provided to allow a user to quickly and efficiently unlock or release one component of the end forming assembly from another component of the end forming assembly.

For example, a shuttle assembly for use with the end forming machine includes a shuttle and a release mechanism coupled to the shuttle. The shuttle includes a main body, a tool-receiving bore formed in the main body, and a lock mechanism associated with the tool-receiving bore. The tool-receiving bore receives an end forming tool or tool holder therein. The lock mechanism includes an oblique bore formed in the main body and in communication with the tool-receiving bore, a spring positioned within the oblique bore, and a ball detent positioned within the oblique bore, engaged with the spring, and biased such that a portion of the ball detent extends into the tool-receiving bore. The lock mechanism is movable between a locked position where a portion of the ball detent is biased to extend into the tool-receiving bore and an unlocked position where the ball detent is removed from within the tool-receiving bore. The release mechanism of the shuttle assembly moves the locking mechanism from the locked position to the unlocked position and includes a release lever coupled to the shuttle for pivotable movement relative to the shuttle to engage the ball detent and move the ball detent out of the tool-receiving bore. A pull-rod of the release mechanism is coupled to the release lever and provided for actuation by a user.

Similarly, a tool holder assembly of the present disclosure is provided for use with the shuttle of the end forming machine. The tool holder assembly is formed to receive an end forming tool in locking engagement therewith and includes a tool holder having a first end adapted to be received within the shuttle and a second end having a tool-receiving bore adapted to receive the end forming tool therein. The tool holder further includes a ball-detent locking mechanism similar to the locking mechanism described above with respect to the shuttle. A release mechanism of the tool holder assembly is coupled to the tool holder and includes a handle coupled to the tool holder for back and forth sliding movement relative to the tool holder. A release-pin of the locking mechanism is coupled to the handle and is positioned within a release-pin slot of the tool holder. The release-pin slot of the tool holder is in communication with the tool-holding bore and the oblique bore. The release-pin is movable back and forth with the handle and within the release-pin slot to engage the ball detent of the locking mechanism and move the ball of the locking mechanism to the unlocked position out of the tool-receiving bore.

According to yet another embodiment of the present disclosure, a release assembly is provided for use with a jaw holder of the end forming machine. The jaw holder is provided to hold a jaw in locking engagement therewith and includes a central, main body, a lower flange coupled to the main body, and an upper flange coupled to the main body and spaced-apart from the lower flange to define a jaw-receiving space between the upper and lower flanges configured to receive the jaw therein. The jaw holder further includes a ball-detent locking mechanism similar to those described above with respect to the shuttle and the tool holder. The release mechanism is coupled to the upper flange of the jaw holder and includes a handle coupled to the jaw holder for back and forth sliding movement relative thereto. A release-pin of the release mechanism is coupled to the handle for back and forth movement with the handle. The jaw holder further includes a release-pin slot in communication with the jaw-receiving space and the oblique bore such that the release-pin of the release mechanism is positioned in the release-pin slot. The release-pin is movable back and forth with the handle and within the release-pin slot to engage the ball detent of the locking mechanism and move the ball detent of the locking mechanism to the unlocked position out of the tool-receiving bore.

Additional features of the present disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompany figures in which:

FIG. 4 illustrates a sectional view of the shuttle assembly of FIGS. 1–3 showing a lock mechanism of the shuttle, including a spring and ball detent, in a locked position engaged with the tool holder to lock the tool holder to the shuttle and also showing the release assembly of the shuttle assembly including a release lever engaged with the ball detent to move the lock mechanism to an unlocked position (shown in FIG. 5), an actuator or pull-rod coupled to the release lever, and a handle coupled to the pull-rod;

FIG. 5 illustrates a sectional view similar to FIG. 4 of a portion of the shuttle assembly showing a user having pulled the actuator to the unlocked or released position to release the ball detent from locking engagement with the tool holder in order to allow the user to remove the tool holder from within the tool-receiving bore of the shuttle to be replaced, for example, by a different tool holder;

FIG. 9 illustrates an exploded, perspective view of a right and left jaw holder and respective right and left jaws provided to be coupled to the respective right and left jaw holders showing each jaw holder having a release mechanism coupled thereto for selectively releasing a respective jaw from locking engagement therewith; and FIG. 10 illustrates a sectional view taken along line 10—10 of FIG. 9 showing the left jaw in locking engagement with the left jaw holder and further showing (in phantom) the release mechanism of the left jaw holder being moved from the locked position to the unlocked or released position to move a ball detent of the locking mechanism out of engagement with the left jaw to unlock the left jaw from the left jaw holder to allow a user to remove the left jaw from the left jaw holder.

DETAILED DESCRIPTION OF THE DRAWINGS

Figure 1:
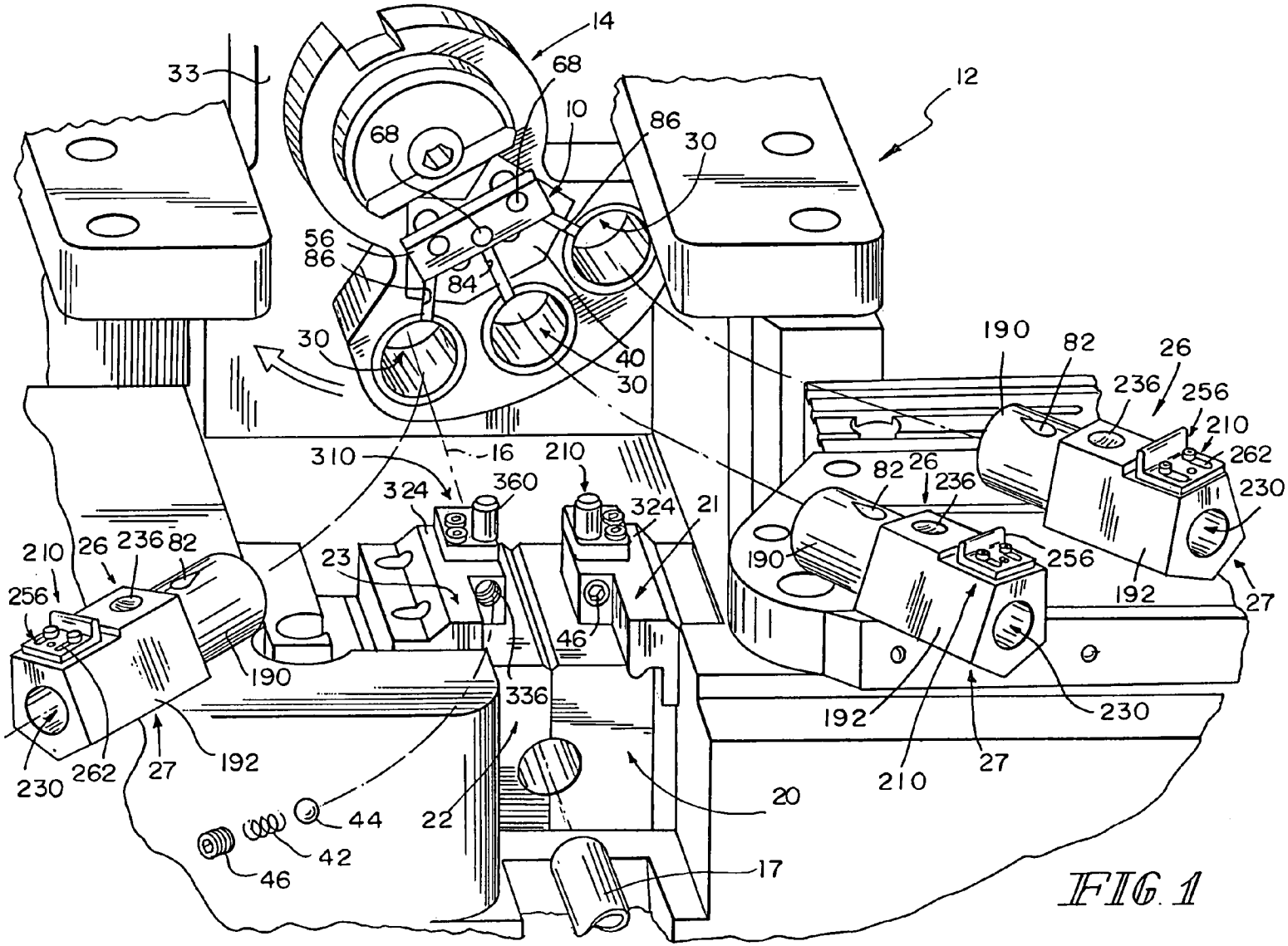
FIG. 1 illustrates a perspective, partially exploded view of a portion of an end forming machine including a three-stroke shuttle assembly having three openings each configured to receive a tool (not shown) and/or a tool holder therein, a set of jaws for holding a work piece, and a set of jaw holders for holding each of the jaws, and further showing the shuttle assembly, jaw holders, and tool holders each having a release mechanism associated therewith for releasing a respective tool holder, jaw, and tool therefrom.

Various lock and release mechanisms are provided for use with an end forming machine 12, shown in FIG. 1. The illustrative end forming machine 12 includes a three-stroke shuttle 14 driven in reciprocating motion by a motor (not shown) along an axis 16. Illustrative tool holder assemblies 26 are coupled to shuttle 14 to hold an end forming tool 18, shown in FIG. 2, for forming a work piece, such as tube 17 (shown in FIG. 1), for example. End forming tools 18 may also be coupled directly to shuttle 14 without the need for tool holder assemblies 26. The work piece 17 is held in a fixed position by a set of jaws 20, 22, shown in FIG. 1, to be formed into a desired configuration.

The lock and release mechanisms disclosed herein and described below are provided to quickly and efficiently lock and unlock one particular component of end forming machine 12 with another corresponding component of end forming machine 12. For example, shuttle 14 includes a lock mechanism 11 (shown in FIGS. 3–6) for locking a tool 18 and/or a tool holder assembly 26 thereto. A release mechanism 10 is coupled to shuttle 14 to move locking mechanism 11 to an unlocked position to allow a user to remove tool holder assembly 26 from shuttle 14. Further, tool holder assembly 26 of end forming machine 12 includes a locking mechanism 11 (shown in FIGS. 4 and 6) for locking a tool 18 thereto. A release mechanism 210 of tool holder assembly 26 is provided to move locking mechanism 11 to an unlocked position to allow a user to remove tool 18 from tool holder assembly 26. Further, a locking mechanism 11 (shown in FIG. 10) of each of right and left jaw holders 21, 23 of end forming machine 12 hold respective right and left jaws 20, 22 in a locked position coupled to jaw holders 21, 23. A release mechanism 310 is coupled to each jaw holder 21, 23 to move locking mechanism 11 of each jaw holder 21, 23 to an unlocked position to allow a user to remove the jaws 20, 22 from jaw holders 21, 23. As is discussed in more detail below, these release mechanisms 10, 210, 310 of end forming machine 12 allow a user to quickly and efficiently remove and exchange one particular component of the machine 12 with another.

As mentioned above, release mechanism 10 is coupled to three-stroke shuttle 14 to form a shuttle assembly 24, as shown in FIGS. 2–6. Release mechanism 10 is provided to selectively unlock one or more tool holder assemblies 26 from within shuttle 14 to allow a user to remove and/or exchange tool holder assemblies 26. Tool holder assembly 26 holds or carries an end forming tool, such as tool 18 shown in FIG. 2, for example, for reciprocating movement therewith. In the alternative, tool 18 may be coupled directly to shuttle 14. Illustrative tool holders are often used when a shaft of the end forming tool is not configured to fit in the particular shuttle being used. Tool holders thus allow a tool to be coupled indirectly to a particular shuttle. As mentioned above, the lock mechanism 11 of shuttle 14 couples or locks the illustrative tool holder assembly 26 (or tool 18) to shuttle 14 for back and forth movement therewith. Illustrative release mechanism 10 allows a user to quickly and easily move locking mechanism 11 to an unlocked position to remove the tool holder assembly 26 from locking engagement within shuttle 14.

Looking now to FIGS. 2–5, illustrative three-stroke shuttle assembly 24 includes shuttle 14 and release mechanism 10 coupled thereto. Shuttle 14 includes three tool-receiving bores 30 formed through a main body 32 of shuttle 14. Each bore 30 is formed to receive tool holder assembly 26 and/or tool 18 therein. Another bore 34 (shown in FIGS.

3 and 4) is provided to receive a coupling member 35 for coupling shuttle 14 to a platen 33 (shown in FIG. 1) driven by the drive motor (not shown) for back and forth reciprocal movement.

Figure 4:
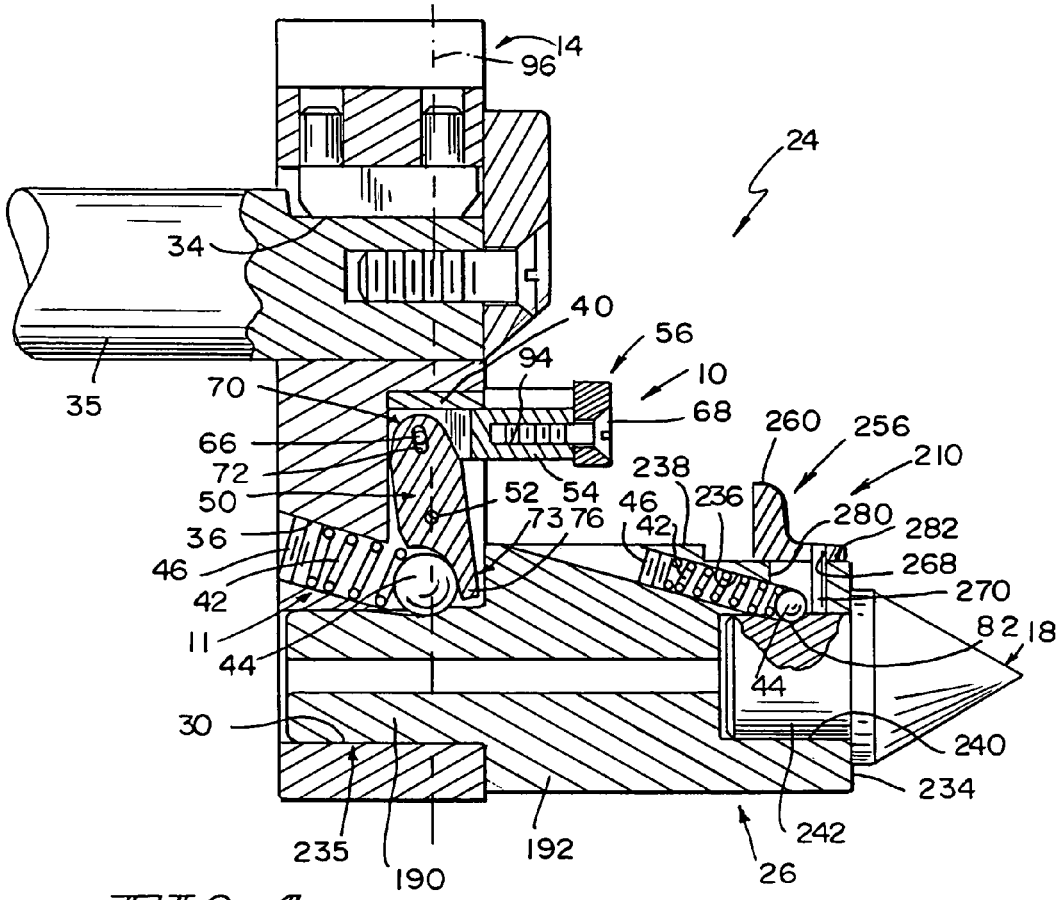
FIGS. 4 and 5 illustrate sectional views of the shuttle assembly of FIGS. 1–3 showing the release mechanism of the shuttle assembly moving from a locked position (FIG. 4) to an unlocked or released position (FIG. 5) to release the tool holder coupled to the shuttle.
Figure 5:
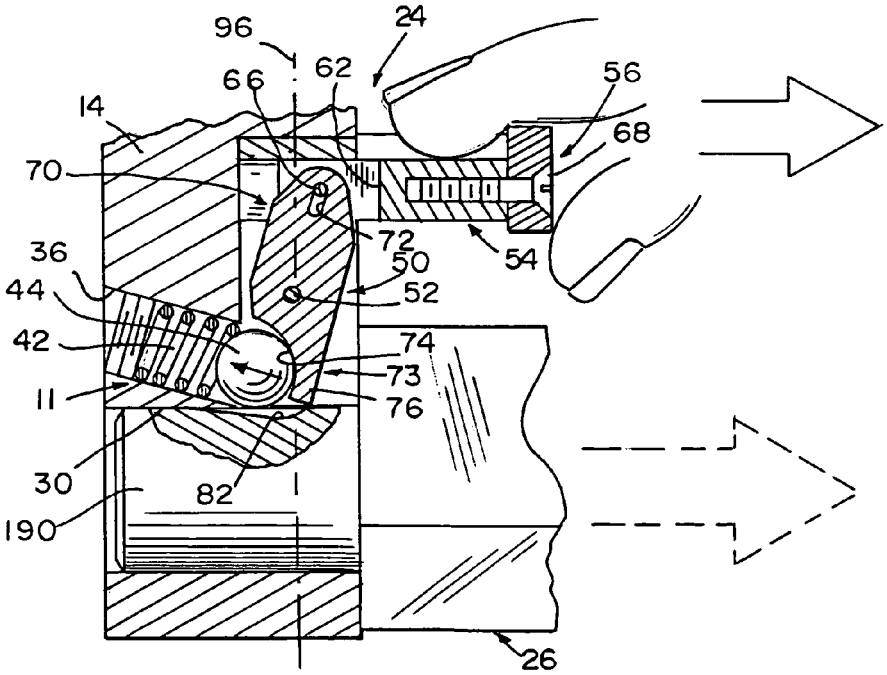
Figure 6:
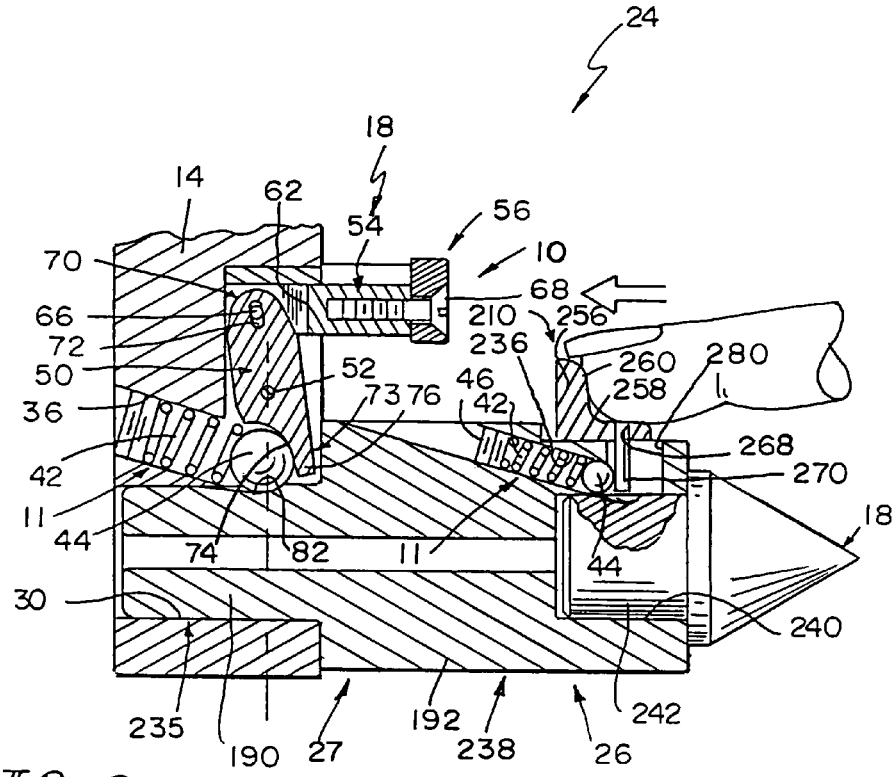
FIG. 6 illustrates a sectional view similar to FIGS. 4 and 5 showing a user moving a release mechanism coupled to the tool holder to an unlocked or release position in order to remove a tool from locking engagement within the tool holder.

Shuttle 14 further includes three lock mechanisms 11 each including an oblique or angled bore 36, shown best in FIGS. 4–6, formed through main body 32 for communication with a respective tool-receiving bore 30. Each lock mechanism 11 is provided to lock a particular tool 18 within a respective one of the tool-receiving bores 30 to lock the tool 18 to shuttle 14 for back and forth reciprocating movement therewith during operation of machine 12. Each lock mechanism 11 further includes a spring 42 received within the oblique bore 36, as shown in FIGS. 4–6, and a ball 44 biased by the spring 42 to partially protrude into the respective tool-receiving bore 30. A stopper or plug 46 is received within oblique bore 36 to engage a first end of spring 42. Spring 42 acts against plug 46 positioned within angled bore 36. As is discussed in greater detail below, ball 44 acts as a detent when the lock mechanism 11 is in the locked position to be received within a corresponding notch, illustratively, a teardrop shaped notch 82, of each tool holder assembly 26 in order to lock tool holder assembly 26 within bore 30.

Illustratively, because shuttle 14 is a three-stroke shuttle and includes three tool-receiving bores 30, three separate release mechanisms 10 are coupled to shuttle 14 such that each release mechanism 10 is associated with one of the three lock mechanisms 11. As mentioned above, each lock mechanism 11 is associated with one of the three tool-receiving bores 30. Although three release mechanisms 10 and three lock mechanisms 11 are provided with shuttle assembly 24, reference herein is made to the components of only one release mechanism 10 and one lock mechanism 11. Similar or same reference numerals are used throughout to denote like components of each release mechanism 10 and each lock mechanism 11.

As mentioned above, each lock mechanism 11 illustratively acts to lock a tool holder assembly 26 within a respective tool-receiving bore 30 of shuttle 14. Lock mechanism 11 is movable from a locked position, as shown in FIG. 4, where ball detent 44 protrudes into tool-receiving bore 30, to an unlocked position, as shown in FIG. 5, where ball detent 44 has been moved against the bias of spring 42 within oblique bore 36 to a position removed from within the tool-receiving bore 30. Each release mechanism 10 is provided to move the respective lock mechanism 11 from the locked position to the unlocked position in order to allow a user to remove the tool holder assembly 26 from within tool-receiving bore 30.

Figures 2, 2A:
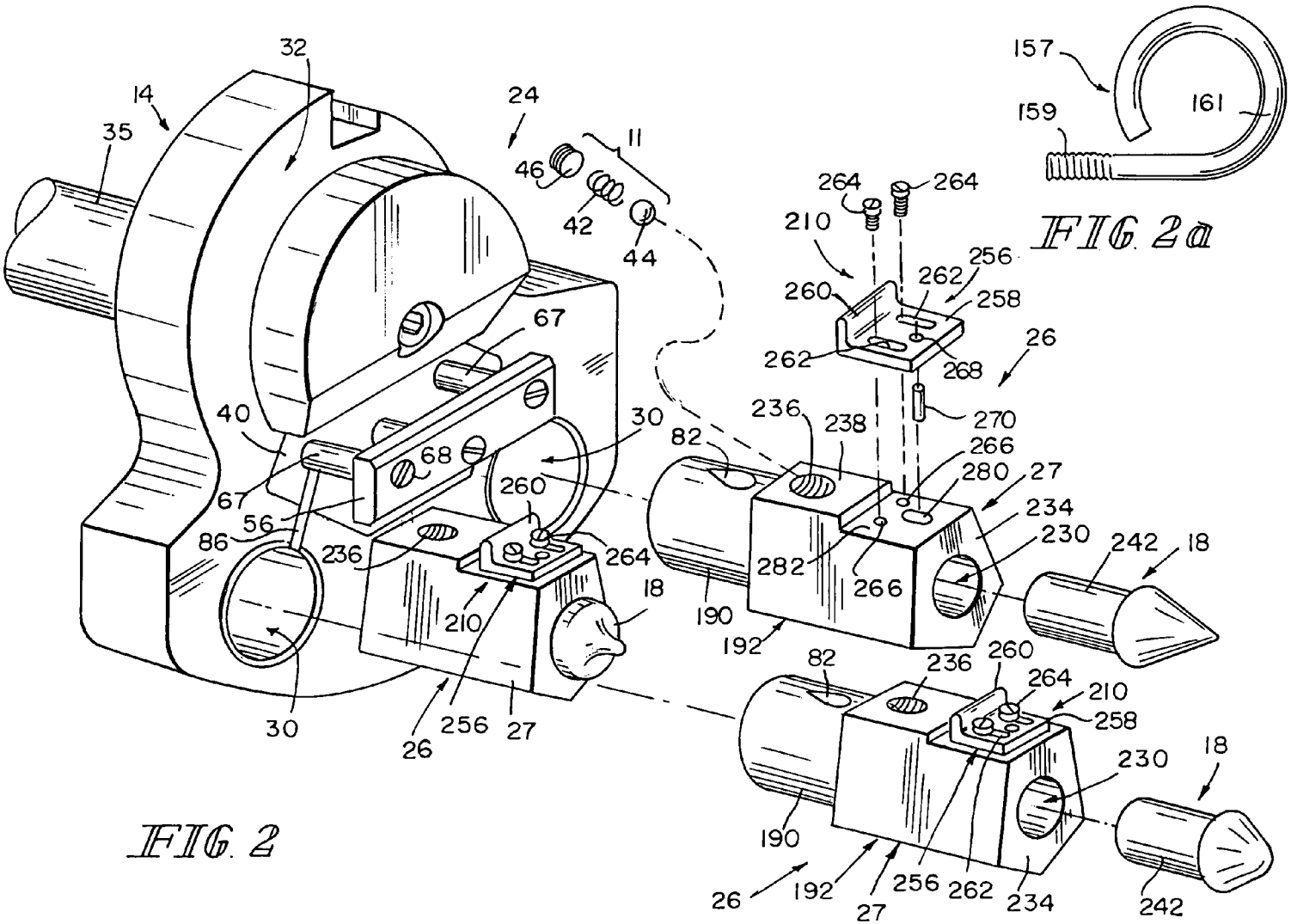
FIG. 2 illustrates a perspective, partially exploded view of the three-stroke shuttle assembly of FIG. 1 showing the assembly including a three-stroke shuttle and the release mechanism coupled to a portion of the shuttle, and further showing a tool holder received in a locked position within a middle tool-receiving bore of the shuttle.
FIG. 2*a* illustrates a side view of an alternative handle of the release mechanism of the shuttle assembly of FIGS. 1 and 2.

A pivot block 40 is received within a recess 38 formed in main body 32 of shuttle 14, as shown in FIG. 2. Illustratively, pivot block 40 is a component of shuttle 14 separate from main body 32. However, it is within the scope of this disclosure to include a shuttle 14 having a unitary main body and pivot block. Pivot block 40 includes three apertures 69 each associated with one of the release mechanisms 10. A slot 84 is formed through pivot bock 40 between each aperture 69 and a corresponding slot 86 formed within main body 32 of shuttle 14. Each slot 86 extends between recess 38 (to be aligned with a corresponding slot 84 of pivot block 40) and a respective tool-receiving bore 30, as shown best in FIG. 3. Pivot block 40 further includes two fastener-receiving apertures 88 each provided to receive a fastener, such as a screw 90. Each screw 90 is also received into a respective aperture 89 of main body 32, which are aligned with apertures 88 of pivot block 40 in order to couple pivot block 40 to main body 32 of shuttle 14.

Each release mechanism 10 includes a release lever 50 engaged with ball detent 44 and coupled to pivot block 40 by a pin 52 for pivoting movement about pin 52 to move ball detent 44 against the bias of spring 42, as shown in FIGS. 4 and 5 and described in more detail below. Each release mechanism 10 further includes a pull-rod 54 having a handle 56 attached thereto. As shown in FIG. 2, the illustrative handle 56 is a single handle coupled to the three different pull-rods 54 such that grasping and activating handle 56 also activates each of the three pull-rods 54. It is also within the scope of this disclosure, however, to include a separate handle coupled to each pull-rod in order to activate each pull-rod separately. For example, an alternative, single handle 157 is shown in FIG. 2*a*. Alternative handle 157 includes a threaded portion 159 to be received within a threaded opening 94 of one of the pull-rods 54. Alternative handle 157 also includes a curved body portion 161 to be grasped by a user when actuating the release mechanism. As mentioned above, illustrative handle 157 is a single handle and is thus provided to be coupled to one pull-rod 54 in order to allow the user to activate each pull-rod 54 of shuttle assembly 24 separately.

Figure 3:
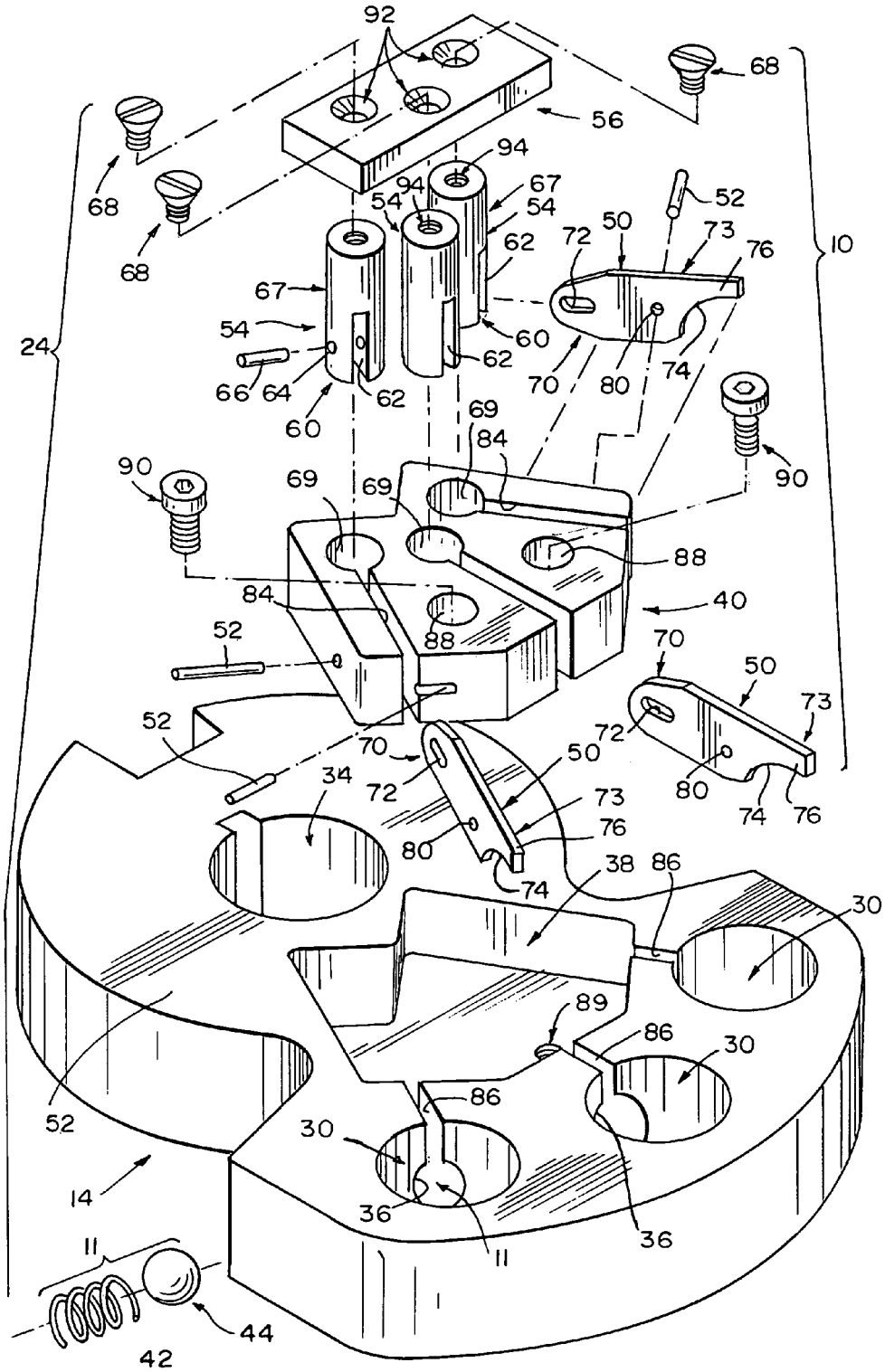
FIG. 3 illustrates an exploded, perspective view of the shuttle assembly, including the three-stroke shuttle and the release mechanism.

Each pull-rod 54 includes a first end 60 having a slot 62 formed therein for receiving a portion of release lever 50 therein. An aperture 64 through first end 60 is formed to receive a pin 66 therethrough to couple pull-rod 54 to release lever 50 for pivotable movement of release lever 50 relative to pull-rod 54. A second end 67 of each pull-rod 54 is coupled to handle 56 by a fastener 68 such as a screw, nail, or rivet, for example. Each fastener 68 is received through a respective aperture 92 of handle 56 and into a threaded opening 94 of each respective pull-rod 54 to secure handle 56 to each pull-rod 54 for movement therewith. First end 60 of each pull-rod 54 is received within aperture 69 of pivot block 40, as shown in FIGS. 3–5.

Each release lever 50 includes a first end 70 having a slot 72 formed therein for receiving pin 66 therethrough to pivotably couple first end 70 of release lever 50 to first end 60 of pull-rod 54. A second end 73 of release lever 50 includes a cut-out-portion 74 defining a curved edge for engaging a portion of the ball detent 44 therein. A leg 76 of release lever 50, formed by cut-out-portion 74 and including a portion of the curved edge, thus engages ball detent 44 of lock mechanism 11 and acts on ball detent 44 when activated to move ball detent 44 against the bias of spring 42 thus moving lock mechanism 11 to the unlocked position. Each release lever 50 is positioned within one of the respective pairs of connecting slots 86 of pivot block 40 and slots 88 of main body 32. Each release lever 50 is movable within the respective slots 86 and 88 between an at-rest or unactuated position (shown in FIG. 4) where ball detent 44 is in the unitialized locked position and an actuated position where the pull-rod 56 has been pulled in a direction away from the main body 32 to move the release lever 50 against ball detent 44.

Particularly, when release mechanism 10 is in the unactuated position, release lever 50 is positioned such that slot 72 of release lever 50 is positioned to the left of an axis 96 which runs perpendicular to pivot pin 52, as shown in FIG. 4. In the actuated position, however, slot 72 of release lever 50 is positioned to the right of axis 96, as shown in FIG. 5. As mentioned above, a pivot pin 52 is received through an aperture 80 of release lever 50 to couple release lever 50 to pivot block 40 and shuttle 14. Illustratively, release lever 50 is coupled to pivot block 40 at a point between first and second ends 70, 72 of release lever 50 for pivotable movement relative to pivot block 40. Slot 72 of release lever 50 allows release lever 50 to pivot about pin 52 as pull-rod 56 is moved away from shuttle 14 to pull first end 70 of release lever 50 in the same direction by way of pin 66. In other words, slot 72 allows pin 66 to move in a linear direction with pull-rod 56 while first end 70 of release lever 50 moves in an arcuate direction as release lever 50 is pivoted about pin 52.

As shown in FIG. 4, lock mechanism 11 is in a locked position such that spring 42 is biasing ball detent 44 into engagement with tool holder assembly 26 received within tool-receiving bore 30. Specifically, a portion of ball detent 44 rests within a tear-drop shaped notch 82 of tool holder assembly 26 to retain tool holder assembly 26 in a locked position within tool-receiving bore 30 during operation of end forming machine 12. Similarly, release mechanism 10 is in a first, unactuated position disengaged from or not acting on the locking mechanism 11. To move lock mechanism 11 to an unlocked position in order to remove tool holder assembly 26 from within bore 30, a user grasps handle 56 and pulls handle 56 in a direction away from shuttle 14, as shown in FIG. 5 to move release mechanism 10 to a second, actuated position. Moving handle 56 in a direction away from shuttle 14 also moves pull-rod 54 in the same direction. Release lever 50, coupled at first end 70 to pull-rod 54, is urged to pivot in a clockwise direction about pivot pin 52 to move leg 76 of release lever 50 substantially to the left (as shown in FIG. 5) against ball detent 44. As mentioned above, slot 72 of release lever 50 allows release lever 50 to move relative to pull-rod 54 while urged to pivot about pin 52 to provide for a smooth or even operation of release lever 50.

As mentioned above, leg 76 of release lever 50 pushes against ball detent 44 to move ball detent 44 against the bias of spring 42 within oblique bore 36 and out of tool-receiving bore 30 to disengage tool holder assembly 26. Once tool holder assembly 26 has been disengaged by ball detent 44, or once ball detent 44 is removed from the locked position within notch 82 of tool holder assembly 26, tool holder assembly 26 may be removed from within bore 30 by the user. Illustratively, when inserting tool holder assembly 26 (or a tool 18) into bore 30, the tool holder assembly 26 (or tool 18) itself biases ball detent 44 against spring 42 until tool holder assembly 26 is properly situated within bore 30 such that tear-drop shaped notch 82 is aligned with the opening of oblique bore 36 into tool-receiving bore 30. At this point, ball detent 44 is urged by spring 42 to rest in the locked position within notch 82 of the particular tool 18 or tool holder which has been inserted into bore 30.

As mentioned above, the three release mechanisms 10 of three-stroke shuttle assembly 24 share a single pull-handle 56 which is coupled to three different pull-rods 54. Thus, pulling pull-handle 56 away from shuttle 14 will move each release mechanism 10 to the release or actuated position to unlock each respective lock mechanism 11 by moving each ball detent 44 within each oblique bore 36 against the bias of each spring 42 to unlock and allow a user to remove any tool(s) or tool holder(s) which may be positioned within any one of the three tool-receiving bores 30 of three-stroke shuttle 14. It is also within the scope of the disclosure, however, for shuttle assembly 24 to include three separate pull-handles such that a separate pull-handle is coupled to each pull-rod in order to unlock each tool or tool holder separately.

Figure 7:
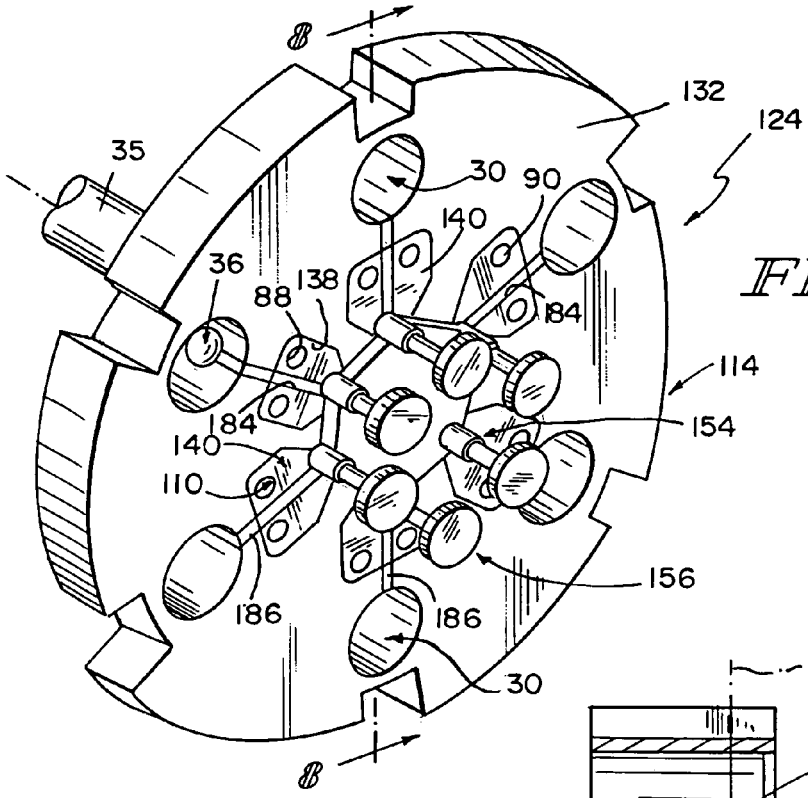
FIG. 7 illustrates a perspective view of an alternative shuttle assembly showing the shuttle assembly having a six-stroke shuttle and a release mechanism associated with each of the six tool-receiving bores of the shuttle for receiving tools and/or tool holders therein.
Figure 8:
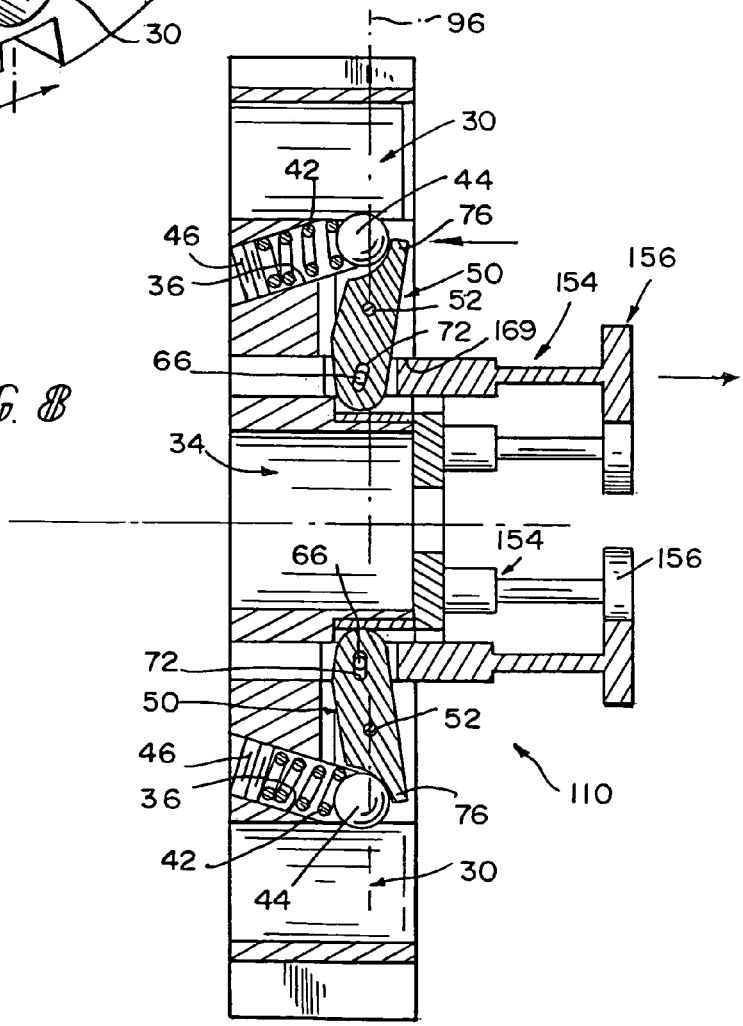
FIG. 8 illustrates a sectional view taken along line 8—8 of the six-stroke shuttle assembly of FIG. 7 showing each release mechanism including a pull-handle and a release lever and also showing a locking mechanism, including a ball detent and a spring positioned to bias the ball detent into the respective tool-receiving bore, associated with each release mechanism.

Although a three-stroke shuttle, such as shuttle 14, is described and shown for use within end forming machine 12, it is within the scope of this disclosure for other shuttles or shuttle assemblies to be used as well. For example, an alternative shuttle assembly 124 having a six-stroke shuttle 114 and six release mechanisms 110 coupled thereto, shown in FIGS. 7 and 8, may be used as well. Six-stroke shuttle 114 includes six tool-receiving bores 30 formed through a substantially circular or disc-shaped main body 132 of shuttle 114. Similar to the bores 30 of three-stroke shuttle 14, each bore 30 of six-stroke shuttle 114 is formed to receive either a tool holder assembly, such as illustrative tool holder assembly 26, or an end forming tool, such as illustrative tool 18, therein. Central bore 34, shown in FIG. 8, is provided to receive coupling member 35 shown in FIG. 7, for coupling shuttle 114 (as well as shuttle 14) to platen 33 driven by the drive motor (not shown) for back and forth reciprocal movement of the shuttle 114.

Six-stroke shuttle 114 includes six lock mechanisms 11 each associated with one of the six tool-receiving bores 30. A release mechanism 110 of shuttle assembly 124 is associated with each bore 30 of six-stroke shuttle 114; therefore, shuttle assembly 124 includes six release mechanisms 110. Similar to shuttle 14, each lock mechanism 11 of shuttle 114 includes an oblique bore 36, shown in FIG. 8, in communication with each tool-receiving bore 30.

Shuttle 114 further includes six recesses 138. Each recess 138 is associated with one of the tool-receiving bores 30 and receives a pivot block 140 therein. The pivot block 140 houses a portion of each release mechanism 110. Each pivot block 140 includes an aperture 169 for receiving a portion of a respective release mechanism 110 therein. A slot 184 is formed through pivot block 140 between the aperture 169 and a corresponding slot 186 formed within main body 132 and formed to align with slot 184. Each slot 186 of main body 132 extends between a respective tool-receiving bore 30 and a respective recess 138. Pivot block 140 further includes two fastener-receiving apertures 88 each provided to receive a fastener, such as a screw 90, in order to couple pivot block 140 to main body 132 of shuttle 114.

Release mechanism 110 is similar to release mechanism 10; therefore, like reference numerals have been used. Each release mechanism 110 of shuttle assembly 124 includes a separate handle 156 and a pull-rod 154 coupled to each handle 156. Each pull-rod 154 is received within one of the apertures 169 of each pivot block 140. Whereas in the embodiment illustrated in FIGS. 1–6, a single handle 56 of shuttle assembly 24 is provided and the pull-rods 54 of shuttle assemblies 24 are coupled to common handle 56, each pull-rod 154 of shuttle assembly 124 is coupled to a separate handle 156. Each release mechanism 110 of shuttle assembly 124, therefore, may be operated independently from each other release mechanism 110 of shuttle assembly 124. However, it is within the scope of this disclosure for shuttle assembly 124 to include a single handle (not shown) such that each pull-rod is coupled to the single handle in order to operate each release assembly at the same time. It is further within the scope of this disclosure for shuttle assembly 124 to include a variety of handles, each coupled to more than one but fewer than all, pull-rods 154 to actuate various groups of release mechanisms 110 simultaneously. Each release mechanism 110 of shuttle assembly 124 further includes release lever 50 coupled to pull-rod 154. Each release mechanism 110 operates in the same manner as each release assembly 10 of shuttle assembly 24 such that as pull-rod 154 is moved to the right (as viewed in FIG. 8) away from shuttle 114, release lever 50 is pivoted about pin 52 to act against ball detent 44 to move lock mechanism 11 to the unlocked position.

Looking now to FIGS. 4 and 6, a release mechanism 210 of tool holder assembly 26 (illustratively shown received within one of the tool-receiving bores 30 of three-stroke shuttle 14) is provided to selectively lock tool 18 therein. Tool holder assembly 26 includes a tool holder 27 and release mechanism 210 coupled thereto. As shown in FIG. 6, tool holder 27 includes a first end 235 having a shaft 190 formed to be received within tool-receiving bore 30 of shuttle 14 (as well as shuttle 114). As discussed above, shaft 190 includes a tear-drop shaped notch 82 formed therein for receiving a portion of ball detent 44 of lock mechanism 11 of shuttle 14 in order to lock tool holder assembly 26 within bore 30 for reciprocal movement therewith.

Tool holder 27 also includes a second, tool-holding end 238 having a tool-receiving bore 240 formed therein for receiving a shaft 242 of a tool, such as tool 18, therein. Release mechanism 210 of tool holder assembly 26 is coupled to second end 238 and operates in much the same way as release mechanisms 10, 110 described above. Release mechanism 210 is provided to release tool 18 from a locked position within bore 240 in order to remove and replace tool 18 with another tool, for example.

Lock mechanism 11 of tool holder 27 is similar to lock mechanisms 11 of shuttles 14 and 114 described above; therefore, like reference numerals have been used to denote like components. Lock mechanism 11 includes spring 42 and ball detent 44, as shown in FIGS. 2 and 6, located within an oblique bore 236 of tool holder 27. Oblique bore 236 is in communication with tool-receiving bore 240, as shown in FIG. 6 to allow a portion of ball detent 44 to extend into tool-receiving bore 240 to contact a shaft end 242 of tool 18. Plug 46 of lock mechanism 11 is inserted into oblique bore 36 to retain spring 42.

Release mechanism 210 is similar to release mechanisms 10, 110 described above. Therefore, like reference numerals have been used to denote like components. A handle 256 of release mechanism 210 is generally L-shaped in section illustrated in FIGS. 4 and 6 and includes a horizontal main body 258 and a vertical lip 260 coupled to the main body 258 and extending upwardly therefrom. Two slots 262 are formed through main body 258, as shown in FIG. 2. A screw 264 is received through each slot 262 and into a respective aperture 266 formed in tool holder 27 to secure handle 256 to tool holder 27. As is discussed in more detail below, slots 262 allow handle 256 to slide back and forth relative to tool holder 27 between actuated and unactuated positions. Handle 256 further includes an aperture 268 formed in the main body 258 and illustratively positioned between the two slots 262. A release-pin 270 is received within aperture 268 and is coupled to handle 256 for sliding movement therewith. Pin 270 may be press-fitted into aperture 268 and/or may be secured to main body 258 by a fastener such as a screw or a rivet, for example. Further, pin 270 may be welded onto main body 258 or may be formed as a unitary component with handle 256, for example.

Illustrative tool holder assembly 27, as shown in FIG. 2, includes a shaft 190 to be received within the tool-receiving bore 30 of shuttle 14 (or shuttle 114). As discussed above, tear-drop shaped notch 82 is formed in shaft 190 to receive a portion of ball detent 44 of lock mechanism 11 therein to lock tool holder 27 to shuttle 14 (or shuttle 114) for reciprocating movement therewith. A main body 192 of tool holder 27 is coupled to shaft 190 and includes a tool-receiving bore 240 for receiving shaft 242 of tool 18 therein. Illustrative bore 240 is formed through an end face 234 of main body 192.

An oblique bore 236, similar to oblique bores 36 formed in shuttles 14, 114, is formed in main body 192 of tool holder 27 and extends from an upper surface 238 of main body 192 into communication with tool-receiving bore 240. Spring 42 and a ball detent 44 of lock mechanism 11 are positioned within oblique bore 236 such that a portion of ball detent 44 extends into tool-receiving bore 240 to contact tool 18. Shaft 242 of tool 18 is illustratively formed to include a tear-drop shaped notch 82 to receive a portion of the ball detent 44 therein when in the locked position within bore 240.

A release-pin slot 280 formed within an upper surface 282 of main body 192 of tool holder 27 communicates with oblique bore 236, as shown best in FIGS. 4 and 6. Illustratively, pin 270 of handle 256 is received within slot 280 and is movable with handle 256 between a first, unactuated position (shown in FIG. 4) spaced apart from, or not engaged with, ball detent 44. Ball detent 44 is normally biased by spring 42 to be received, at least in part, within notch 82 of tool 18 to lock tool 18 within bore 240. Thus, as shown in FIG. 4, lock mechanism 210 is in the locked position to retain tool 18 within bore 240 for back and forth movement of tool 18 with tool holder assembly 26 during operation of the end forming machine 12.

Looking now to FIG. 6, a user has moved handle 256 to the left (as shown in FIG. 6) to slide pin 270 with handle 256 within slot 280 of tool holder 27. As handle 256 is slid to the left toward the actuated position, pin 270 of handle 256 engages ball detent 44 and moves ball detent 44 against the bias of the spring 42 out of bore 240 and thus out of tear-drop shaped notch 82 to a position further within oblique bore 236. Once release mechanism 210 has been moved to the actuated position, shown in FIG. 6, and ball detent 44 has been removed from within notch 82, the user is free to remove tool 18 from within bore 240 in order to replace tool 18 with another tool, for example. Once the user releases handle 256, spring 42 acts to bias ball detent 44 against pin 270 to move lock mechanism 11 back to the locked position and to move release mechanism 210 back to the unactuated position shown in FIG. 4.

As disclosed herein, release mechanisms 10, 110, 210 are provided to quickly and efficiently remove a first item from a locked position within a second item. For example, lock mechanisms 11 are provided to lock tool holder assemblies 26 within bores 30 of respective shuttles 14, 114. Further, each release mechanism 10, 110 is provided to allow a user to quickly unlock the tool holder assembly 26 from within bore 30 to quickly and efficiently remove and replace tool holder assembly 26 from within bore 30. As mentioned above, a tool (not shown) may be formed or adapted to be received within bore 30 of respective shuttles 14, 114 without the need for a tool holder, such as tool holder assembly 26, for example. Such a tool may be unlocked from within bore 30 by release mechanisms 10, 110. Similarly, lock mechanism of tool holder assembly 26 is provided to lock tool 18 within bore 240 of tool holder 76. Release mechanism 210 is therefore provided to allow a user to quickly unlock the tool 18 from within tool holder 27 to quickly and efficiently remove and replace tool 18.

Another release mechanism 310 of end forming machine 12 is provided. As mentioned above and shown in FIG. 1, end forming machine 12 includes a pair of jaws 20, 22 formed to receive and hold therein a workpiece 17 to be formed by the reciprocating motion and impact of one or more tools 18. Illustrative jaws 20, 22 are each held in place by a respective pair of jaw holders 21, 23, as shown in FIGS. 1 and 9. A lock mechanism 11 of each jaw holder 21, 23 is provided to lock each respective jaw 20, 22 thereto. Each release mechanism 310 is provided to allow a user to quickly unlock and remove each jaw 20, 22 from each respective jaw holder 21, 23 when it is desired to remove and replace a particular jaw for holding a particular workpiece, for example. The release mechanism 310 and each respective jaw holder 21, 23 cooperate to define a jaw holder assembly 325.

Looking now to FIGS. 9 and 10, it is shown that each jaw holder 21, 23 is generally C-shaped in end view and includes a central body 320, a lower leg or flange 322 coupled to body 320, and an upper leg or flange 324 coupled to body 320. Each jaw 20, 22 is formed to be received between upper and lower flanges 324, 322 in a jaw-receiving space 326 to be held securely therebetween.

Illustrative release mechanism 310 is coupled to upper flange 324, as shown in FIG. 9. A portion of upper flange 324 includes an oblique bore 336 formed therein for receiving ball detent 44 and spring 42 therein, as shown in FIG. 10. Oblique bore 336 is formed to extend between a first angled surface 338 of flange 324 and a bottom surface 340 of flange 324, as shown in FIG. 10. Opening 342 formed by oblique bore 336 through bottom surface 340 communicates with the jaw-receiving space 326 between upper and lower flanges 324, 322 of each jaw holder 21, 23 formed to receive a respective jaw 20, 22 therein. Similar to the lock mechanisms 11 described above, a portion of ball detent 44 extends through opening 342 to engage a respective jaw 20 or 22 when inserted therein. Specifically, ball detent 44 rests within tear-drop shaped notch 82 of a respective jaw 20, 22.

A release-pin slot 344 is also formed through a portion of flange 324. As shown in FIG. 10, slot 344 and oblique bore 336 are in communication with each other such that ball detent 44 extends, at least in part, within slot 344 when lock mechanism 11 is in the locked position.

A handle 350 of release mechanism 310 is coupled to flange 324 and is movable back and forth, as shown in FIG. 10, relative to flange 324 between unactuated and actuated positions. A pin 352 is coupled to handle 350 and positioned to extend downwardly into slot 344 of flange 324, similar to pin 270 of release mechanism 210 described above. Screws 354 of handle 350, similar to screws 264 of handle 256, may be received within a slot or slots (not shown) of handle 350 in order to slidably couple handle 350 to flange 324. A knob 360 of handle 350 is provided for a user to slide handle 350 back and forth between unactuated and actuated positions.

As shown in FIG. 10, lock mechanism 11 is in the locked position such that ball detent 44 is received, at least in part, within tear-drop shaped notch 82 of illustrative jaw 20 to lockjaw 20 within jaw holder 21. As shown in phantom in FIG. 10, a user may slide handle 350 to the left in order to move release mechanism 310 to the actuated position. As handle 350 is moved to the left toward the actuated position, pin 352 of handle 350 engages ball detent 44 and moves ball detent 44 out of notch 82 and back up into oblique bore 336. Once ball detent 44 has been removed from within notch 82, lock mechanism 11 is in the unlocked position and jaw 20 may be removed from within jaw holder 21. Once a user releases handle 350, the bias of spring 42 acting on ball detent 44 will press against pin 352 and move handle 350 back to the unactuated position.

The invention claimed is:

1. A shuttle assembly for use with an end forming machine and formed to receive a tool or tool holder therein, the shuttle assembly comprising a shuttle having a main body, a tool-receiving bore formed in the main body, and a lock mechanism associated with the tool-receiving bore, the lock mechanism including an oblique bore formed in the main body and in communication with the tool-receiving bore, a spring positioned within the oblique bore, and a ball detent positioned within the oblique bore, engaged with the spring, and biased such that a portion of the ball detent extends into the tool-receiving bore, the lock mechanism being movable between a locked position where a portion of the ball detent is biased to extend into the tool-receiving bore and an unlocked position where the ball detent is removed from within the tool-receiving bore, and a release mechanism coupled to the shuttle for moving the locking mechanism from the locked position to the unlocked position, the release mechanism comprising a release lever coupled to the shuttle for pivotable movement relative to the shuttle to engage the ball detent and move the ball detent out of the tool-receiving bore.

2. The shuttle assembly of claim 1, wherein the release mechanism further includes a pull-rod coupled to the release lever to move the release lever between the first and second positions.

3. The shuttle assembly of claim 2, wherein the release lever includes a first end coupled to the pull-rod and a second end formed to engage the ball detent of the locking mechanism, and wherein the release lever is pivotably coupled to the shuttle at a point between the first and second ends of the release lever.

4. The shuttle assembly of claim 2, wherein the release lever includes a slot formed therein, the pull-rod includes an aperture formed therein, and wherein the release mechanism further includes a pin received within the slot of the release lever and the aperture of the pull-rod to pivotably couple the release lever to the pull-rod.

5. The shuttle assembly of claim 2, wherein the pull-rod includes a slot formed therein and a portion of the release lever is positioned within the slot to permit pivoting movement of the release lever about the pivot point relative to the pull-rod.

6. The shuttle assembly of claim 1, wherein the shuttle includes a slot in communication with the tool-receiving bore and the oblique bore, and wherein the release lever is positioned within the slot.

7. The shuttle assembly of claim 1, wherein the release lever includes a cut-out portion defining a leg and wherein the leg of the release lever engages the ball detent of the lock mechanism when moving the lock mechanism to the unlocked position.

8. The shuttle assembly of claim 1, wherein the release lever includes a first end having a slot formed therein and a second end defining a leg formed to engage the ball detent of the locking mechanism.

9. The shuttle assembly of claim 1, wherein the release lever of the shuttle assembly is a first release lever and wherein the shuttle assembly includes a second release lever and a handle coupled to the first and second release levers to actuate the first and second release levers simultaneously.

10. A tool holder assembly for use with a shuttle of an end forming machine and formed to receive an end forming tool in locking engagement therewith, the tool holder assembly including a tool holder having a first end adapted to be received within the shuttle and a second end having a tool-receiving bore adapted to receive the end forming tool therein, the tool holder further including a locking mechanism including an oblique bore of the tool holder in communication with the tool-receiving bore, a ball received within the oblique bore, and a spring received within the oblique bore to urge a portion of the ball into the tool-receiving bore, and a release mechanism coupled to the tool holder, the release mechanism including a handle coupled to the tool holder for back and forth sliding movement along an axis of the tool holder parallel to the tool-receiving bore and a release-pin coupled to the handle for back and forth movement therewith, wherein the tool holder further includes a release-pin slot in communication with the tool-receiving bore and the oblique bore, wherein the release-pin of the release mechanism is positioned in the release-pin bore, and wherein the release-pin is movable within the release-pin slot to engage the ball detent of the locking mechanism and move the ball of the locking mechanism to the unlocked position out of the tool-receiving bore.

11. A tool holder assembly of claim 10, wherein the handle of the release mechanism includes a slot formed to receive a fastener therethrough to slidably couple the handle to the tool holder.

12. The tool holder assembly of claim 11, wherein the handle includes a generally horizontal main body and a vertical lip coupled to the main body and extending upwardly therefrom, and wherein the slot is formed through the main body of the handle.

13. A jaw holder assembly for use with an end forming machine and formed to receive an jaw in locking engagement therewith, the jaw holder assembly including a jaw holder being generally "C-shaped" and having a central, main body, a lower flange coupled to the main body, and an upper flange coupled to the main body and spaced apart from the lower flange to define a jaw-receiving space between the upper and lower flanges configured to receive a jaw therein, the jaw holder further including a locking mechanism including an oblique bore of the upper flange in communication with the jaw-receiving space, a ball received within the oblique bore, and a spring received within the oblique bore to urge a portion of the ball into the jaw-receiving space, and a release mechanism coupled to the upper flange of the jaw holder, the release mechanism including a handle coupled to the jaw holder for back and forth sliding movement relative thereto and a release-pin coupled to the handle for back and forth movement with the handle, wherein the jaw holder further includes a release-pin slot in communication with the jaw-receiving space and the oblique bore, wherein the release-pin of the release mechanism is positioned in the release-pin slot, and wherein the release-pin is movable within the release-pin slot to engage the ball detent of the locking mechanism and move the ball detent of the locking mechanism to the unlocked position out of the tool-receiving bore.

* * * * *